United States Patent [19]

DeVall et al.

[11] Patent Number: 4,506,501

[45] Date of Patent: Mar. 26, 1985

[54] APPARATUS FOR REPAIRING CHAINS

[76] Inventors: Donald L. DeVall, 1082 Charles Ave.; Hu D. DeVall, Rte. 1, Box 362-A; Clarence L. Tennant, 10 W. Fifth St., all of Morgantown, W. Va. 26505

[21] Appl. No.: 471,863

[22] Filed: Mar. 3, 1983

[51] Int. Cl.[3] ..... B21L 9/06

[52] U.S. Cl. ..... 59/7; 29/251; 29/252; 29/402.09

[58] Field of Search ..... 59/11, 7; 29/402.09, 29/402.11, 402.12, 238, 523, 251, 252

[56] References Cited

U.S. PATENT DOCUMENTS

| | | | |
|---|---|---|---|
| 2,256,718 | 9/1941 | Kreiter | 59/7 |
| 3,028,724 | 4/1962 | Kaplan et al. | 59/7 |
| 3,075,346 | 1/1963 | Quarve et al. | 29/252 |
| 3,075,347 | 1/1963 | Bonifas et al. | 59/7 |
| 3,553,960 | 1/1971 | Ellefson | 59/7 |
| 4,365,401 | 12/1982 | Ogren | 59/11 |

FOREIGN PATENT DOCUMENTS

| | | | |
|---|---|---|---|
| 981419 | 1/1951 | France | 59/7 |

*Primary Examiner*—Francis S. Husar

*Assistant Examiner*—Linda McLaughlin

*Attorney, Agent, or Firm*—Webb, Burden, Robinson & Webb

[57] ABSTRACT

Apparatus for repairing a section of chain having a closed rectangular frame and a hydraulic ram located within the confines of the frame. The frame has a pair of spaced parallel side rails, a front end member connecting one end of the side rails, and a rear end member connecting the other end of the side rails. Each side rail has a U-shaped downwardly opening notch located between the front end member and the rear end member to lie over a chain to be worked on. An anvil is located on a face of the front end member and the front member is removably connected to the side rails so it may be reversed relative to the side rails to locate the anvil within the confines of the frame when connecting chain sections and outside of the confines of the frame when disconnecting chain sections. The ram has a first head which contacts chain connecting pins to disconnect chain sections and a second head which contacts a link to connect chain sections. The second head carries cylindrical cutters for shearing retainer pins from chain connecting pins.

12 Claims, 10 Drawing Figures

APPARATUS FOR REPAIRING CHAINS

BACKGROUND OF THE INVENTION

1. Field of the Invention

This invention relates generally to apparatus for disconnecting and connecting two sections of chain. More particularly, this invention relates to a portable apparatus which can accommodate roller chains of different widths and which includes cutters to shear the retaining pins from the chain link connecting pins prior to forcing the connecting pins out of one of the links.

2. Description of the Prior Art

There are devices in the prior art for removing connecting pins from a chain link. Such devices are disclosed in U.S. Pat. Nos. 2,256,718; 3,553,960; 3,028,724 and 3,075,347. However, all of the devices disclosed in these patents are large and complicated and most of them are permanently installed on a bench in a shop.

The apparatus disclosed in U.S. Pat. No. 2,256,718 is stated to be portable, but this apparatus is much more cumbersome and difficult to operate than applicants' apparatus. It includes a mechanical rack arrangement and a lever drive to actuate the movable head which forces the connecting pins out of the chain link, and this is undesirable since the amount of force which can be used to drive the connecting pins out of the link depends on the strength of the operator. Additionally, the apparatus disclosed in this patent cannot be used in confined quarters such as at a mine face or within the confines of a machine because there must be adequate room to operate the lever to move the connecting pin removing head. Furthermore, this apparatus requires a number of workmen to lift the chain being worked on onto the sprocket plate prior to removing the connecting pins, and such is extremely difficult because of the size and weight of the chain.

SUMMARY OF THE INVENTION

The connecting pin remover of the invention is simple in both construction and operation and is relatively light in weight so that it can be moved by one workman from one location to another to operate upon a chain. This is extremely important in such places as coal mines wherein the conveyer chains on continuous mining machines and on longwall equipment are in need of repair and at construction sites where it is not convenient to disassemble a piece of equipment in order to take a traction chain to a shop to remove the connecting pins in order to repair or replace a section of chain. Additionally, the apparatus of the invention may be placed over the chain to be worked on so that it is not necessry to lift the chain prior to working on it.

The apparatus of the invention is portable and includes a frame with a reversible forward end plate carrying an anvil which may be placed within the confines of the frame so that the apparatus may be used to place a link on the connecting pins or outside of the confines of the frame to remove the connecting pins from a chain link to make necessary repairs or to shorten a chain. The apparatus includes a hydraulically operated ram within the confines of the frame, and the ram is reversible in order to present either the connecting pin removing head or the retaining pin cutting and link connecting head to the chain link which is being worked on. The side rails of the frame have opposed downwardly opening U-shaped slots which are dropped over the portion of the chain to be worked on to hold the chain in position while adjacent sections are being connected or disconnected.

DESCRIPTION OF THE PREFERRED EMBODIMENT

Figure 1:
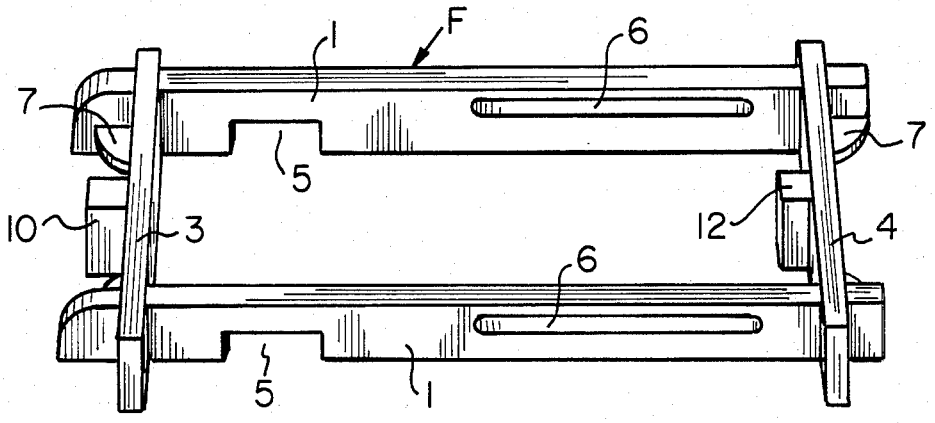
FIG. 1 is a perspective view of the frame with the anvil outside of the frame.

With reference to FIG. 1 of the drawings, a frame F has a pair of spaced, substantially parallel side rails 1 which are connected at one end by a reversible front end member 3 and at the other end by a rear end member 4. Each side rail is formed with an upwardly opening U-shaped slot at each end extending through a portion of its height, and front end member 3 and rear end member 4 are both formed with a downwardly opening U-shaped slot at each end through a portion of their height. When the frame is assembled, the upwardly opening slots in the side rails receive the downwardly opening slots in front end member 3 and rear end member 4 to attach the front and rear end members to the side rails. It is important that the frame be constructed in this manner since front end member 3 must be reversible and the frame must have a certain amount of play in order to permit a slight degree of twist when force is applied to the connecting pins or to a link by ram R. If the frame is a rigid welded construction, it could not withstand the twist when substantial force is applied to the connecting pins or to a chain link by ram R and the welds would break. The reason that front end plate 3 must be reversed is pointed out hereinafter.

Figure 2:
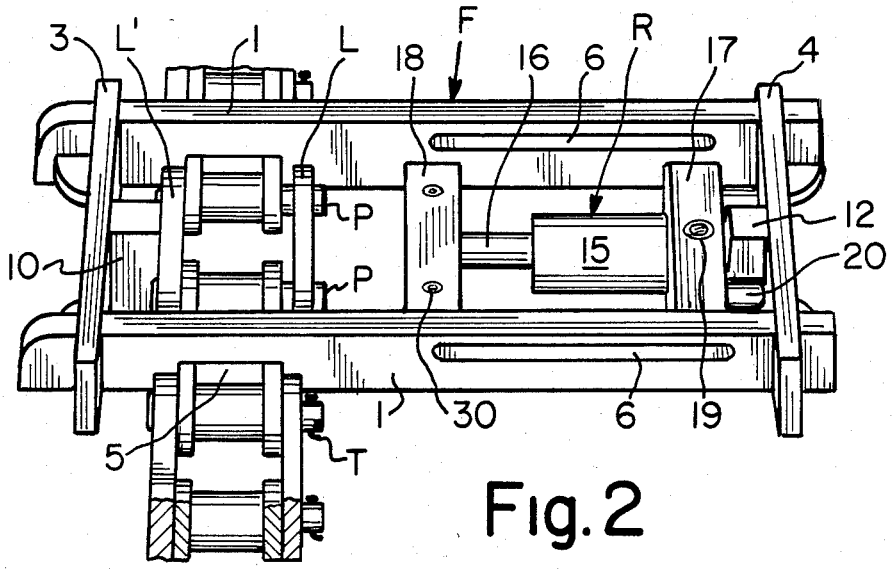
FIG. 2 is a perspective view with the frame over a section of chain with the anvil within the frame and the ram in position to connect two sections of chain.
Figure 3:
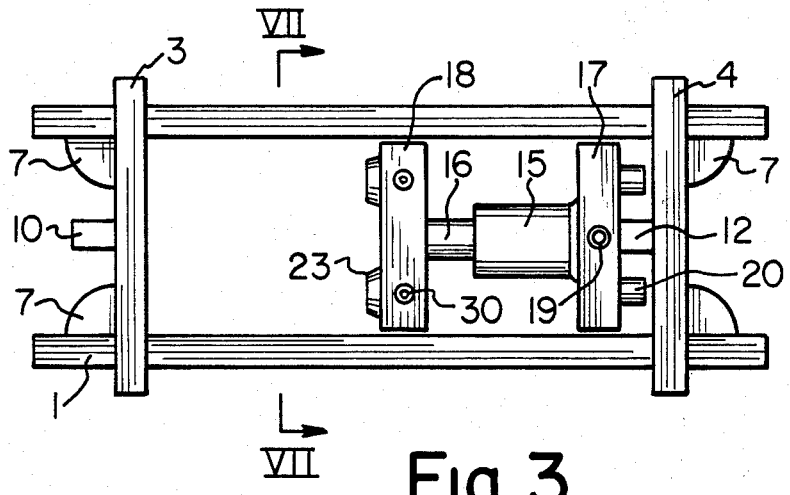
FIG. 3 is a plan view of the apparatus with the ram in the retaining pin shearing position.
Figure 4:
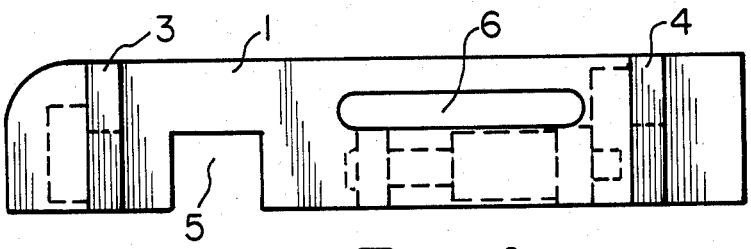
FIG. 4 is a side view of the apparatus shown in FIG. 3.
Figure 5:
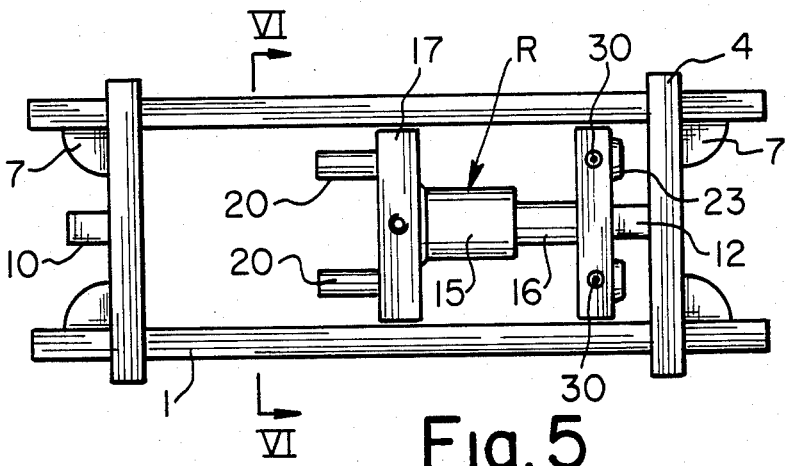
FIG. 5 is a plan view of the apparatus with the ram in the connecting pin removing position.
Figure 6:
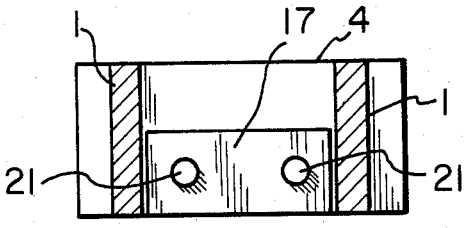
FIG. 6 is a section of line VI—VI of FIG. 5.
Figure 7:
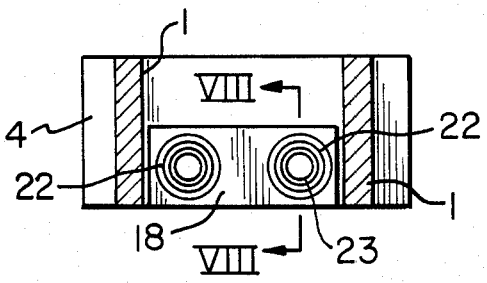
FIG. 7 is a section of line VII—VII of FIG. 3.
Figure 10:
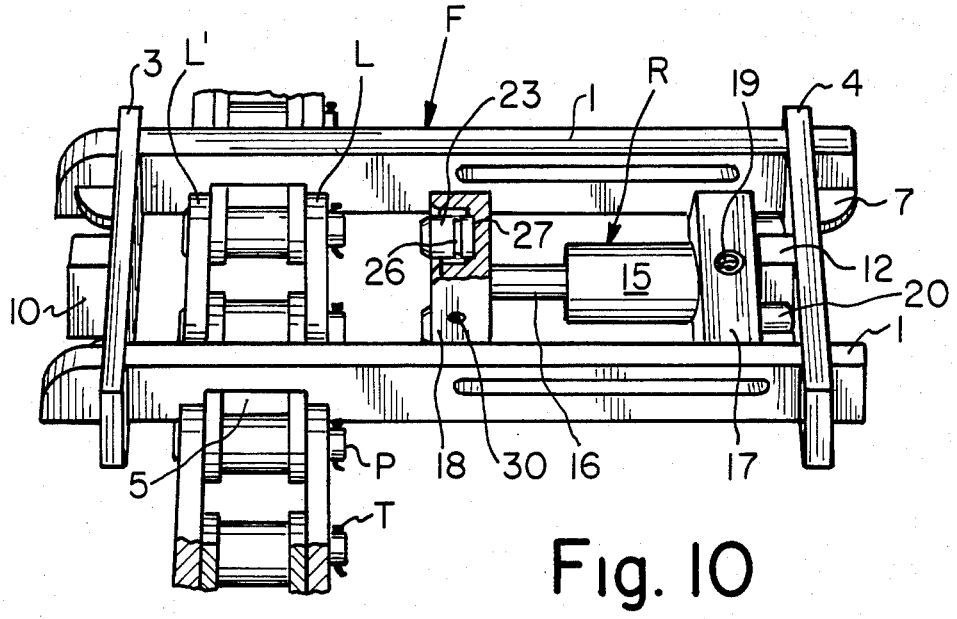
FIG. 10 is a perspective view with the frame over a section of chain and the ram in position to shear the retaining pins.
Figure 9:
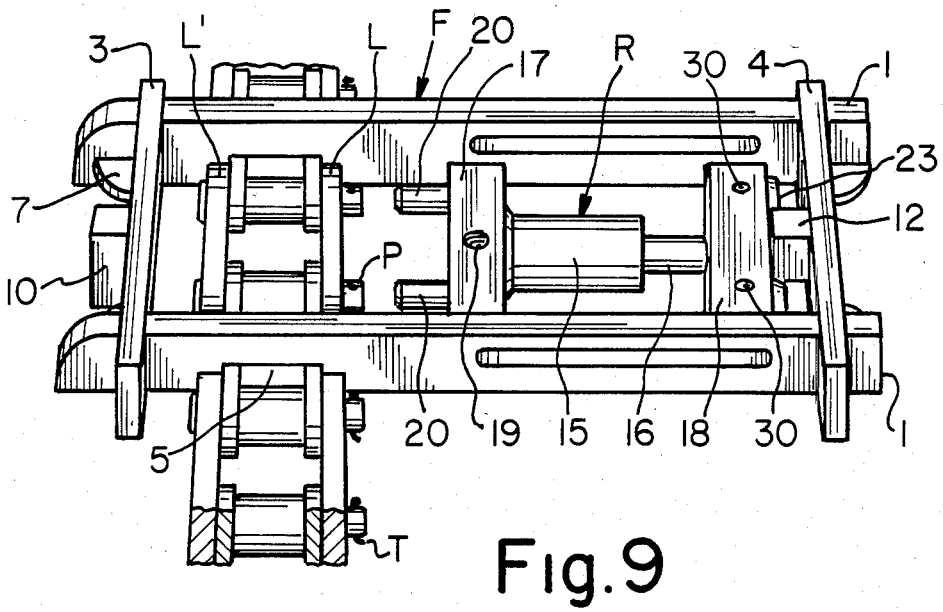
FIG. 9 is a perspective view with the frame over a section of chain and the ram in position to remove a pair of connecting pins after the retainer pins have been sheared.

Each side rail 1 is also formed with an elongated downwardly opening U-shaped notch 5 adjacent to the front end which fits loosely over the chain in the manner shown in FIGS. 2, 9 and 10 of the drawings to hold the chain during both the pin removing operation and the link pressing operation. As will be apparent from a consideration of FIG. 9 of the drawings, when force is applied to connecting pins P by ram R, the edge of the chain sections adjacent to the link being operated on will contact the front vertical edge of notches 5 to resist movement of the chain section while permitting movement of the connecting pins out of link L. Each side member is also provided with an elongated opening 6 located rearwardly of notch 5. Openings 6 are used to lift frame F and place it over a chain so that notches 5 overlie the chain sections adjacent to the link to be operated on.

Supporting gussets 7 are welded to the inner face of each side rail 1 at the ends thereof so that when front and rear end members are in position and the apparatus is in operation, a part of the force applied to the front and rear end members by ram R is taken by the gussets. The gussets are not welded to the front and rear members since, as stated above, these members are attached to side rails 1 by means of the complementary interlocking slots in the side rails and the front and rear end members.

As will be seen from a comparison of FIG. 2 with FIGS. 9 and 10 of the drawings, front end member 3 which has an anvil 10 welded thereto is reversed to perform different operations with the apparatus. Thus, in FIG. 2 a link L is to be pressed onto connecting pins P, and the front end member is positioned with anvil 10 within frame F so that the anvil face will contact the link L' carrying connecting pins P and hold link L' in position while link L is pressed onto the connecting pins. Alternatively, in FIGS. 9 and 10 where retaining pins T are to be sheared and connecting pins P are to be removed from link L, front end member 3 is reversed so that anvil 10 is located outside of frame F. In this arrangement, retaining pins T are sheared and the connecting pins are pushed out of link L and carry link L' with them, and the force of ram R is taken by the contact between chain sections adjacent to the link being worked on and the forward edges of notches 5.

The rear end member 4 has a contact block 12 welded to one surface thereof and located within frame F. As is apparent from a comparison of FIGS. 2 and 9, contact block 12 is always located within the frame. This contact block contacts one of the heads of ram R at all times when the apparatus is in operation.

The ram R consists of a standard hydraulic cylinder 15 having a piston rod 16 extending from one end. One end of cylinder 15 is welded to a connector pin pushing head 17 which is the first head, and the free end of rod 16 is welded to a retainer pin shearing and link assembly head 18 which is the second head. A threaded fitting 19 is located on head 17 for connection to a hose from a source of hydraulic fluid in order to provide hydraulic fluid to cylinder 15 to extend rod 16 relative to cylinder 15. A second fitting (not shown) is located on cylinder 15 to provide hydraulic fluid to the cylinder to retract rod 16. The hydraulic pressure souce may be a commercially available portable pump sold by Enerpac located in Butler, Wisconsin under the name "Enerpac Pump." The amount of pressure necessary is determined by the size and type of chain which is to be worked on and upon the condition of the chain.

The head 17 includes a pair of spaced push rods 20 having contact ends 21 which contact the ends of connecting pins P to push the connecting pins out of the openings in link L. As will be seen in FIGS. 2 and 10 of the drawings, the spacing of puch rods 20 and the size of contact block 12 are such that the push rods straddle the contact block when ram R is in position to insert link L on the connecting pins and to shear retainer pins T. The contact block is dimensioned to provide clearance between contact ends 21 of the push rods and the inner surface of rear end member 4.

Figure 8:
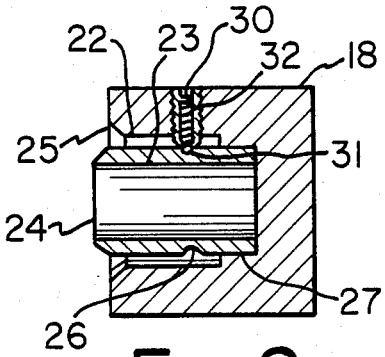
FIG. 8 is a section of line VIII—VIII of FIG. 7.

The head 18 is formed with a pair of spaced cylindrical recesses 22 which receive a hollow cylindrical retaining pin cutter 23. The forward end of each cutter is tapered to a cutting edge 24 as shown in FIG. 8 and extends outwardly beyond the face of head 18. The open end of each cylindrical recess 22 is formed with a chamfer 25 which opens away from the cutting edge on the cylindrical cutter located within the recess. This arrangement permits the sheared ends of retainer pins T to pass into the space between the outer surface of cylindrical cutter 23 and the surface of cylindrical recess 22 after the ends of the retainer pins are sheared. The rear end of each cutter 23 extends into a cylindrical socket 27 formed in the base of each cylindrical recess 22 to center the cutter in the recess.

In order to permit removal of hollow cylindrical cutters 23, each individual cutter is held in a recess head 18 by the arrangement shown in FIG. 8 of the drawings. A set screw 30 having a longitudinal passage with a coil spring 32 located therein and a spring loaded detent ball 31 at the end of the longitudinal passage is threaded in head 18 above each recess 22. The diameter of detent ball 31 and the diameter of the opening at the end of the longitudinal passage in set screw 30 are such that only a portion of the ball is forced out of the opening. The ball cannot pass completely through the opening. The ball is forced toward the outer surface of the cutter 23 in a recess 22 by the coil spring in the screw 30. Each cutter 23 is formed with an annular groove 26 in its outer surface which receives the detent ball 31 extending through the opening at the end of the longitudinal passage in set screw 30 to hold the cutter in position in a recess 22. Since each cutter is held in position in its recess by a spring loaded detent ball 31 which is forced into annular groove 26 by coil spring 32, the cutter may be easily removed prior to using head 18 to press a link L onto a pair of connecting pins P to connect two sections of chain.

While the apparatus is shown with a pair of push rods 20 and a pair of recesses 22, it will be understood by those skilled in the art that the apparatus may be made with a single push rod and a single recess to accommodate a cutter or with a number of push rods and recesses greater than 2. The number of push rods and recesses will be determined by the number of connecting pins in the chain link being worked on.

Ram R is shown in FIGS. 2, 9 and 10 as resting on the same surface as the surface supporting the frame and the chain. This makes it possible to remove the ram from the frame and move it as a separate element when the frame is moved and placed over a chain. It will be understood that heads 17 and 18 may be formed with a slide on each end which will ride longitudinal of frame F in elongated horizontal slots formed in the inner surfaces of side rails 1.

In operation, frame F is placed over a chain from which connecting pins P are to be removed in such a manner that the connection pins are located between the inner surface of the side rails. Prior to removing connecting pins P, the ram is placed in the position shown in FIG. 10 of the drawings with cutters 23 in recesses 22 and hydraulic fluid is applied to the closed end of cylinder 15 to extend rod 16 therefrom so that the cutting edges 24 of cutters 23 contact retainer pins T which extend through a hole in the end of each connecting pin P and shear off the ends of the retainer pins. Cylinder 15 is then exhausted and ram R is reversed in the frame into the position shown in FIG. 9 of the drawings with the rear surface of head 18 against contact block 12. Hydraulic fluid is again applied to the closed end of cylinder 15 to extend rod 16 therefrom and force the contact ends 21 of push rods 20 against the ends of connecting pins P to force the connecting pins out of link L. Fluid under pressure is continuously applied to the closed end of cylinder 15 until the connecting pins are driven completely out of link L.

When two sections of chain are to be connected, link L′ carrying the connecting pins is placed between the two sections of chain so that pins P extend through the bushings on the chain sections with their free ends facing the rear of frame F. The front end member 3 is reversed so that anvil 10 is within frame F so that it can contact the outer surface of link L′. The ram is placed in the position shown in FIG. 2 of the drawings with cutters 23 removed from recesses 22. Fluid pressure is supplied to the closed end of cylinder 15 to force the face of head 18 against the outer surface of link L to drive the link onto connecting pins P. In this operation, the end of each connecting pin is received in a recess 22 in head 18.

While preferred embodiments of the invention have been described and shown herein, it is to be understood that the invention may be embodied within the scope of the appended claims.

We claim:

1. Apparatus for repairing a chain comprising a closed frame and hydraulic ram means located within the confines of said frame, said frame comprising a pair of spaced substantially parallel side rails, a front end member extending between and connected to one end of each of said side rails, and a rear end member extending between and connected to the other end of each of said side rails, said front and rear end members being substantially perpendicular to said substantially parallel side members, each of said side rails having a substantially U-shaped downwardly opening notch located between said front end member and said rear end member and adjacent to said front end member, anvil means on one face of said front end member and means connecting said front end member and said one end of said side rails so that said front end member may be reversed relative to said side rails to locate said anvil means within the confines of said frame when connecting chain sections and outside of the confines of said frame when disconnecting chain sections, said ram means including a first head having means adapted to disconnect adjacent chain sections and a second head having means adapted to connect adjacent chain sections, one of said heads being in contact with said rear end member when said ram means is located within the confines of said frame, whereby said downwardly opening notches in said side rails are adapted to lie over a section of chain to be worked on.

2. Apparatus as set forth in claim 1 wherein said rear end member has a contact block on the inner face within the confines of said frame and one of said heads of said ram means contacts said contact block during operation of said ram means.

3. Apparatus as set forth in claim 1 wherein each of said side rails has an upwardly opening slot adjacent to each end and each of said front and rear end members has a downwardly opening slot adjacent to each end, whereby said slots in said side rails interlock with said slots in said front and rear end members to connect said side rails and said front and rear end members to form said frame.

4. Apparatus as set forth in claim 1 wherein said ram means includes a hydraulic cylinder and a piston rod extending from one end of said hydraulic cylinder, said second head with means to connect chain sections is attached to the free end of said piston rod and said first head with means to disconnect chain sections is attached to the free end of said hydraulic cylinder.

5. Apparatus as set forth in claim 4 wherein said means to disconnect chain sections is a pair of spaced substantially parallel push rods connected to the face of said first head and extending away from the face in a direction parallel to said piston rod, said push rods being spaced the same distance as the spacing of chain connecting pins in links connecting adjacent chain sections, whereby the ends of said push rods are adapted to contact the ends of the connecting pins to force the connecting pins out of a link connecting adjacent chain sections upon application of hydraulic fluid to said cylinder.

6. Apparatus as set forth in claim 4 wherein said means to connect chain sections is the face of said second head.

7. Apparatus as set forth in claim 1 wherein said second head having means adapted to connect chain sections has a pair of spaced cylindrical recesses in the face thereof and a cylindrical cutter located within each of said recesses, each of said cutters having a cylindrical cutting edge extending outwardly of the face of said head adapted to shear retainer pins from connecting pins prior to forcing the connecting pins out of a link, said cylindrical cutting edge being formed by an outwardly directed angle on the end of said cylindrical cutter and means to removably hold each of said cylindrical cutters in a recess in said second head.

8. Apparatus as in claim 7 wherein the exterior diameter of each of said cylindrical cutters is smaller than the diameter of the cylindrical recess within which the cutter is located and the open end of said cylindrical recess is chamfered toward the center of said recess, whereby the chamfer and the cutting edge of said cylindrical cutter will direct sheared retainer pin ends into the space between the outer surface of said cylindrical cutter and the wall of said cylindrical recess.

9. Apparatus as set forth in claim 7 wherein each of said cylindrical cutters is formed with an annular groove in its outer surface and said means to removably hold each of said cylindrical cutters in the recess within which said cylindrical cutter is located extends from said second head into said groove.

10. Apparatus as set forth in claim 7 wherein each of said cylindrical cutters has an annular groove formed in its outer surface and said means to removably hold each of said cylindrical cutters in the recess in which said cylindrical cutter is located is a threaded hole in said second head extending between the exterior of said second head and the surface of the recess within which said cylindrical cutter is located, a set screw threaded in said hole and extending into the recess, a longitudinal passage in said set screw, an opening at the end of said set screw in the recess, and a detent ball located within said longitudinal passage in said set screw extending partially out of said opening and a coil spring in said longitudinal passage contacting said detent ball to bias said detent ball partially out of said opening into said annular groove in said cylindrical cutter.

11. Apparatus as set forth in claim 1 wherein said means to connect chain sections is the face of said second head.

12. Apparatus as set forth in claim 1 wherein said means to disconnect chain sections is a pair of spaced substantially parallel push rods connected to the face of said first head and extending from the face thereof, said push rods being spaced the same distance as the spacing of chain connecting pins in links connecting adjacent chain sections, whereby the ends of said push rods are adapted to contact the ends of the connecting pins to force the connecting pins out of a link connecting adjacent chain sections upon application of hydraulic fluid to said ram means.

* * * * *